United States Patent [19]

Pegg

[11] 4,304,072

[45] Dec. 8, 1981

[54] DOUBLE-HUNG REPLACEMENT WINDOW UNIT

[76] Inventor: Owen C. Pegg, 4699 Keele St., Unit 19, Downsview, Ontario, Canada, M3J 2N8

[21] Appl. No.: 88,079

[22] Filed: Oct. 24, 1979

[51] Int. Cl.[3] ..... E05C 7/02

[52] U.S. Cl. ..... 49/63; 49/450; 49/DIG. 1

[58] Field of Search ..... 49/63, DIG. 1, 450

[56] References Cited

U.S. PATENT DOCUMENTS

| | | | |
|---|---|---|---|
| 3,121,922 | 2/1964 | Niese | 49/63 |
| 3,226,779 | 1/1966 | Rust | 49/63 X |
| 3,403,490 | 10/1968 | Luedtke | 49/DIG. 1 |
| 3,436,884 | 4/1969 | Bell et al. | 49/DIG. 1 |
| 3,925,953 | 12/1975 | La Borde | 49/DIG. 1 |
| 4,151,682 | 5/1979 | Schmidt | 49/DIG. 1 |

*Primary Examiner*—Kenneth Downey

[57] ABSTRACT

A double-hung replacement window unit comprises an outer window and an inner window joined together with mortised joints by plastic thermo-break members on all four sides. The outer and inner windows have an identical construction and each comprises a balanced lower sash and a latched upper sash. The thickness of the window unit may thus limit to about three to five inches and is compatible with existing window openings in buildings particularly older dwelling buildings such that it may be easily used to replace an existing window unit without having to make major modifications to the window opening.

6 Claims, 4 Drawing Figures

DOUBLE-HUNG REPLACEMENT WINDOW UNIT

This invention relates to a window unit and particularly to a replacement metal double-hung window unit usable for replacing wooden or other metal type window units in buildings.

BACKGROUND OF THE INVENTION

Window units in buildings, particularly older dwelling houses are usually made of an wooden frame having two window panels, namely an inner window and an outer window. The double window construction provides high insulation to the building. One type of such double window is commonly referred to as a double-hung window unit in which the sashes of the inner and outer windows are vertically slidable along their frames for opening or closing the windows. In some buildings, particularly older dwelling buildings such window units are made of wooden material which is not durable and readily subject to rot and breakage. Furthermore, it requires re-painting from time to time due to weathering and it is difficult to produce in a mass production process.

The drawbacks of wooden window units may be overcome by replacing them with window units made of a metal frame. Such metal window units lend themselves to mass prefabrication process, provide high durability and require virtually no repainting since the colour may be permanently provided in the metal material in the well known manners. However, in order to provide convenient operability, metal window units are normally provided with fully balanced sashes wherein each sash is provided with a counter balancing tension means such as a counter weight or a counter-biassing spring. The counter balancing tension enables the window to be opened with little force and can maintain it at any selected open position. But, due to the space required in housing the counter balancing mechanism, heretofore, it has been unable to provide a double-hung metal window unit having a thickness comparable or compatible with the existing wooden window units. Window openings in buildings particularly those having wooden window units, are usually provided with a jamb of only three to four inches wide, whereas known metal replacement window units, due to their constructional requirement for housing four counter balancing mechanisms, have a thickness of at least six inches, so that in order to install a metal replacement window unit in the window opening, major alteration must be made in the latter such as by removing the jamb or repositioning it so as to accommodate the window unit. Such major alteration of the window opening is time-consuming and costly to carry out. Attempts have been made to obviate the problems by making the inner window with balanced sashes while the sashes of the outer window are unbalanced and are provided with side latches. The elimination of the counter balancing mechanisms in the outer window in such window unit reduces its thickness to about four inches. However, it is difficult and awkward to operate. In order to operate the latches in the outer window so as to open or close it, one of the balanced sashes in the inner window must be moved downward or upward until the latches in the outer window are accessible for operation for moving the selected sash up or down half way and then the same balanced sash in the inner window must be moved back to its original position and to move the other balanced sash up or down until the previously moved latched sash can be reached to operate its latches so as to move it further or to open the window fully. It can be appreciated that the operation of such window unit is thus very awkward to carry out. Moreover, since the inner and the outer windows are different in construction, namely one has a counter balancing mechanism for both its upper and lower sashes while the other has a latching mechanism, the frame members of the outer window are thus different in configuration and construction from those of the inner window, so that they can not be produced with the same fabrication process.

PURPOSE OF THE INVENTION

The primary object of this invention is to provide a metal replacement window unit having a thickness compatible with the existing window unit in older dwelling buildings such that it can be easily installed in the existing window opening by merely removing the existing window unit and replacing it with the window unit of the present invention without requiring any major alteration to the frame of the window opening.

It is a further object of the present invention to provide a metal double-hung replacement window unit in which the inner and outer windows have an identical construction so as to simplify its production.

It is yet a further object of the present invention to provide a metal double-hung replacement window which has a tight seal joint between the inner and outer windows so as to reduce any vapour condensation therein and to reduce also the heat loss therethrough.

It is yet another further object of the present invention to provide a metal double-hung replacement window unit in which the sashes may be easily cleaned.

Another object of the present invention is to provide a double-hung metal replacement window unit which is simple to operate.

SUMMARY OF THE INVENTION

The above objects are provided with a metal replacement window unit comprising an inner and outer window each of which comprises an identical counter balanced lower sash and an identical upper sash of the non-counter balanced type provided with lateral latches in its upper corners. The inner window and the outer window have identical frame members in which each frame member is provided with an inverted L-shaped lateral flange, thermo-break members having a generally U-shaped cross section with two spun over flanges, these spun over flanges being slidably engaged with the inverted L-shaped lateral flanges of the frame members to form mortised joints therewith and to secure the inner and outer windows together. The window unit thus formed has a thickness of from three to five inches selectively which is compatible with existing wooden window openings in buildings, is convenient to operate and has a high insulation property.

BRIEF DESCRIPTION OF DRAWINGS

Other objects of this invention will appear in the following description and appended claims, reference being made to the accompanying drawings forming a part of the description and specification wherein like reference characters designate corresponding parts in the several view.

DESCRIPTION OF A SPECIFIC EMBODIMENT

Figure 1:
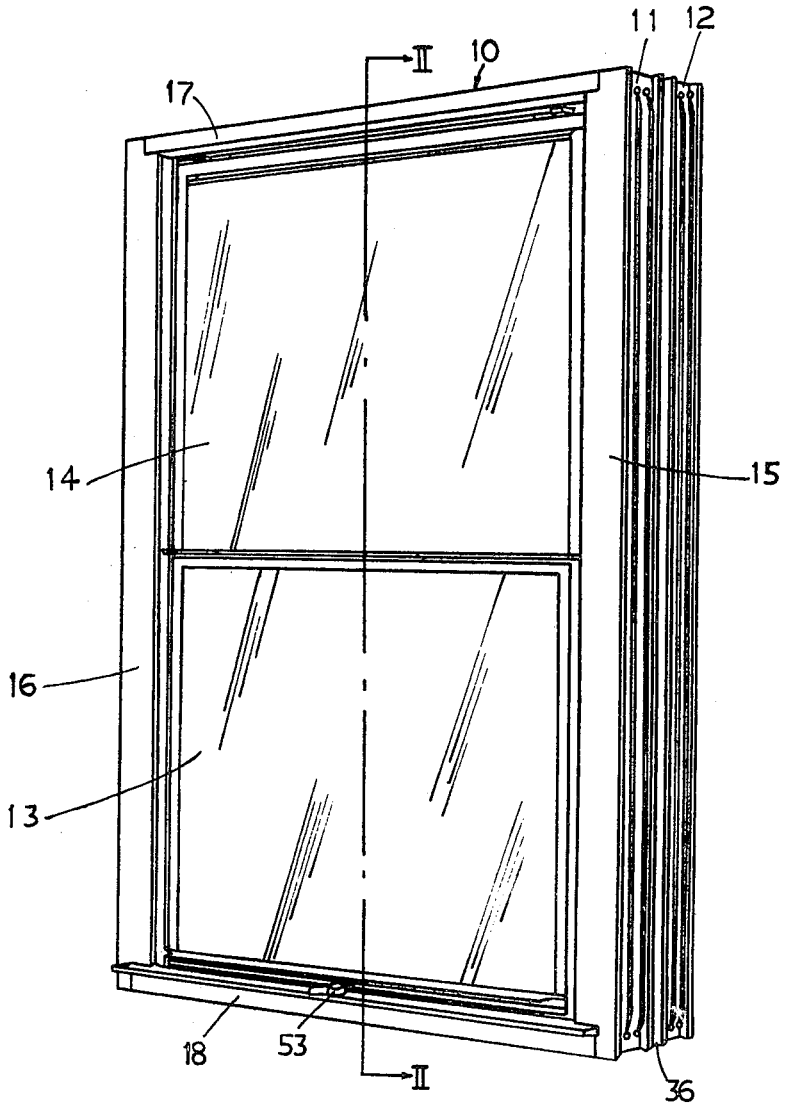
FIG. 1 is a perspective view of the double-hung replacement window unit according to the present invention.

With reference to the drawings, the double-hung replacement window unit 10 of the present invention comprises an inner window 11 and an outer window 12. The two windows 11 and 12 have an identical construction and each comprises a counter balanced lower sash 13 and a non-counter balanced upper sash 14 provided with lateral latches, side frame members 15 and 16, and upper cross frame member 17 and lower cross frame member 18 respectively.

The outside surface of the upper cross frame member 17 is provided with two mutually parallel and spaced inverted L-shaped longitudinal lateral flanges 19 and 20, and two mutually parallel and spaced inverted L-shaped longitudinal inner ribs 21 and 22. Two longitudinal channels 23 and 24 having a generally circular cross section are formed at the inner corners of the base of the inner ribs 21 and 22 respectively. Two parallel and spaced longitudinal ribs 25 and 26 are formed on the inner surface of the upper cross frame member 17 as best shown in FIGS. 2 and 3.

Figure 4:
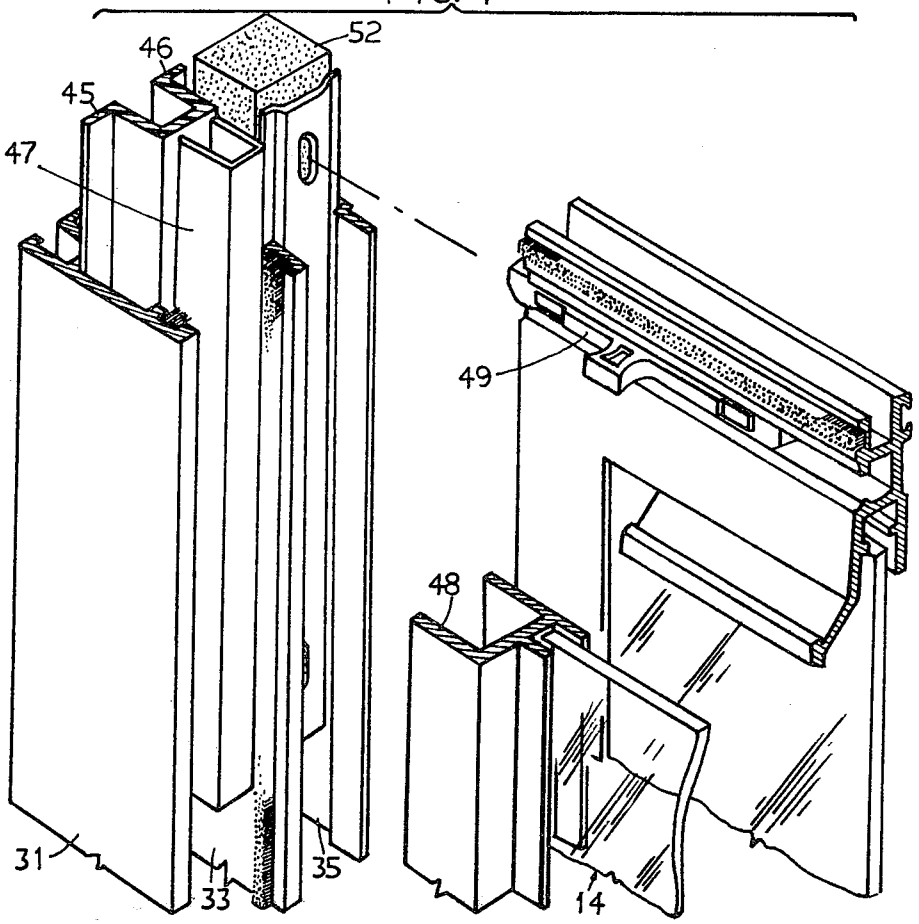
FIG. 4 is an exploded isolated partial perspective view of the window unit of the present invention showing the latch mechanism in the upper sash and part of the counter balancing mechanism in the balanced lower sash.

The outside surface of the side frame members 15 and 16 have two mutually parallel generally L-shaped longitudinal lateral flanges 27 and 28, and two mutually parallel longitudinal L-shaped inner reinforcement ribs 29 and 30. The inner surface of the side frame members 15 and 16 have a generally P-shaped longitudinal lateral flange 31 having a channel 32, a generally P-shaped longitudinal central rib 33 having a channel 34, and a longitudinal step-like lateral flange 35. The channels 32 and 34 are usable for mounting felt strips (as shown in FIG. 4) for abutting the sides of the lower sash so as to enhance smooth sliding movement of the lower sash and to eliminate any direct air passage through the contacting surfaces. The upper cross member 17 is mounted to the side frame member 15 by two tapping screws 36 and 37 extending through two openings 38 and 39 formed close to the end of the side frame member 15 so as to engage with the circular channels 23 and 24.

Figure 2:
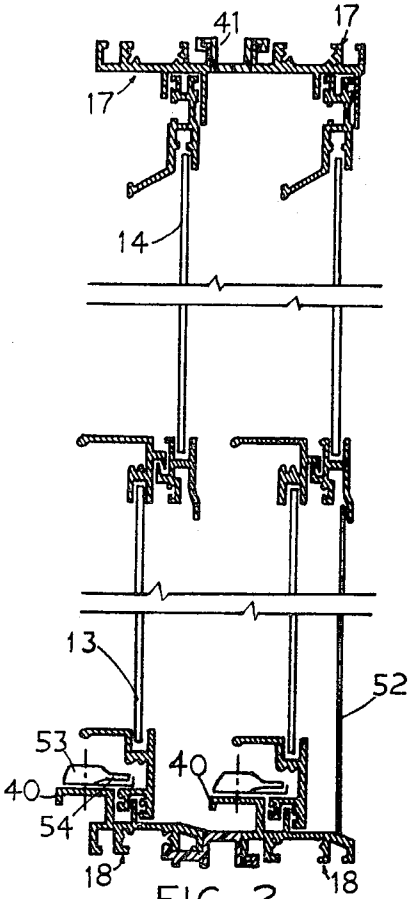
FIG. 2 is a sectional side view of the window unit of the present invention along the section line II—II of FIG. 1.
Figure 3:
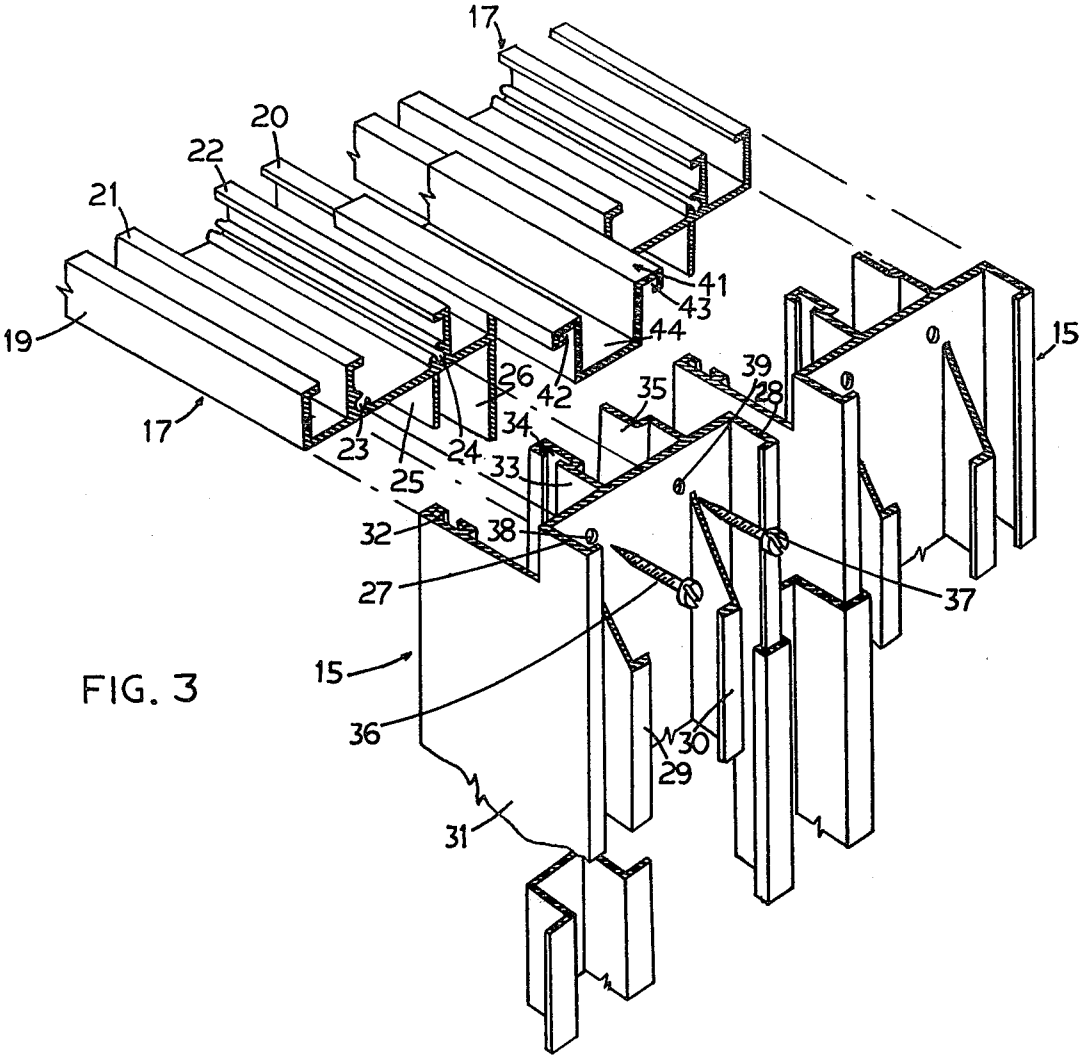
FIG. 3 is an exploded isolated perspective view of the top corner of the window unit of the present invention.

The lower cross frame member 18 has a cross section configuration similar to the upper cross frame member 17 except the outer rib in the inside surface therein includes an additional L-shaped horizontal flange 40 as best shown in FIG. 2. The advantage of having such an additional horizontal flange will become apparent from the following description. All frame members 15, 16, 17 and 18 may be made of metal such as aluminum by such method as continuous metal extrusion in a mass fabrication process as well known to one skilled in the art.

The inner window 11 and the outer window 12 are mounted together by thermo-break members 41 in all four sides. The thermo-break member 41 is generally U-shaped in cross section and having two spun over C-shaped longitudinal lateral flanges 42 and 43 and a central longitudinal web portion 44. The spun over C-shaped lateral flanges 42 and 43 are slidably engageable with the L-shaped longitudinal lateral flanges 27 and 28 of the outer window 12 and the inner window 11 respectively to form mortised joints. The thermo-break members 41 are made of a low thermal conduction material such as plastic for example, vinyl, by a continuous plastic extrusion process. The resilient property of the plastic thermo-break member facilitates it to interlock intimately with the lateral flanges 27 and 28 such that the mortised joint thus formed permits very little, if any, vapour to pass therethrough. Because of such interlock mortised joints the window unit has a high insulation property and allows relatively little heat to be transmitted therethrough or vapour to enter therein to form condensation. The plastic thermo-break member is also not subject to rotting, and thermo-break members of various selected widths may be provided to easily form window units of selected total thicknesses typically from three to five inches, in order to fit existing conventional window openings of various depths. The plastic thermal break members also thermally isolate the metal frames of the inner window from those of the outer window.

The counter balanced lower sash 13 and the upper non-counter balanced sash may be of any known construction provided with aluminium frame members. The counter balancing mechanism 45 of the balanced sash is housed in the inner channel of the side frame members 15 and 16 as shown in FIG. 4. The mechanism comprises a U-shaped longitudinal support member 46 on which a tension spring type counter balancing slider member 47 is mounted. The side frame 48 of the balanced sash 14 is slidably engageable with the counter balancing slider member 47 when the latter is secured on the frame of the window unit.

The frame of the latched upper sash 14 is slidably held between the central rib 33 and the step-like lateral flange 35 of the side frame members 15 and 16. The spring-biassed latch 49 of the latched sash 14 is operative to engage openings 50 in a longitudinal latching plate 51 located in the channel between the central rib 33 and lateral flange 35. The latching plate 51 is backed by a longitudinal resilient strip member 52. The strip member 52 may be made of a material having a high insulation property such as foam rubber, sponge or fiberglass which not only provides the desirable resilient force to urge the latch plate 51 to abut against the side of the latched sash and the upper sash so as to ensure positive engagement of the latch with the openings but also provides desirable insulation in the frame of the window unit.

Commonly the lower sash of a window unit is more subject to breakage and dirt build-up. The provision of a balanced lower sash in the present window unit facilitates the removable of the lower balanced sash in a well known manner from the frame for replacement or cleaning. The upper latched sash also becomes readily accessible for cleaning when the balanced lower sash has been removed from the frame of the window unit.

A screen 52 may be conveniently mounted at the outer window 12 as shown in FIG. 2. The screen is held in place by a skirting lip in the lower cross frame member of the upper latched sash and the upper surface of the lower cross frame member 18 of the outer window 12.

The provision of the relatively large horizontal flange 40 in the lower cross frame member 18 permits the incorporation of a pivotal latch member 53 thereon for locking the lower sash of both the inner and outer windows in the closed position independent of the upper sash. The latch member 53 has a cam portion 54 which is engageable with a channel in the cross frame of the balanced sash.

While the invention has been particularly shown and described with reference to a preferred embodiment thereof, it will be understood by those skilled in the art that various changes in form and detail may be made therein without departing from the spirit and scope of the invention.

What I claim as my invention is:

1. A vertically operative double-hung metal replacement window unit comprising:

an inner window and an outer window having identical frame members, an identical vertically slidable counter balanced lower sash and an identical vertically slidable non-counter balanced upper sash, said frame members comprising two mutually parallel spaced vertical side frame members secured at the upper end therein by an upper cross frame member and at the lower end therein by a lower cross frame member, each of said frame members having two mutually parallel spaced inverted L-shaped lateral longitudinal flanges, said non-counter balanced upper sash having two lateral latches at the upper corners therein operative from the inner side of said upper sash to engage associated openings in said vertical side frame members to lock said upper sash selectively in a closed position and selected vertically opened positions, thermo-break members made of low thermal conduction material and having a generally U-shaped cross section body portion with two spun-over flanges slidably engaged with said inverted L-shaped lateral longitudinal flanges of said frame members between the inner and outer windows to form mortised joints therewith and to secure said inner and outer windows together, said U-shaped body portion being sandwiched between said frame members of the inner and outer windows to serve as a thermal break therebetween.

2. A vertically operative double-hung metal replacement window unit according to claim 1 wherein said thermo-break members are plastic extrusion members.

3. A vertically operative double-hung metal replacement window unit according to claim 1 wherein said thermo-break members are elongated vinyl members.

4. A vertically operative double-hung metal replacement window unit according to claim 1 wherein said upper cross frame member and said lower cross frame member having two longitudinal inner ribs parallel to said longitudinal flanges, two circular longitudinal channels formed at the inner corners of the base of said inner ribs, said lateral frame members having two openings formed close to the ends thereof, and screw means extending through said openings in said lateral frame members to engage with said circular channels in the cross frame members to secure said cross frame members to said vertical frame members in each of said inner window and said outer window.

5. A vertically operative double-hung metal replacement window unit according to claim 4 wherein said lower cross member having a horizontal flange therein, a pivotal latch member mounted on said horizontal flange and operative for locking said lower counter balanced sash of each of said inner window and outer window selectively in a closed position independent of the operation of the non-counter balanced upper sash.

6. A vertically operative double-hung metal replacement window unit according to claim 5 including longitudinal latching plates disposed in said vertical frame members, said associated openings being formed in said latching plates.

* * * * *